United States Patent [19]

Sander et al.

[11] Patent Number: 4,699,313

[45] Date of Patent: Oct. 13, 1987

[54] SAFE COIN BOX

[76] Inventors: Floyd G. Sander, 53 Cool Breeze Dr., Baltimore, Md. 21220; George Spector, 233 Broadway RM 3815, New York, N.Y. 10007

[21] Appl. No.: 877,197

[22] Filed: Jun. 23, 1986

[51] Int. Cl.[4] ..... A45C 1/12

[52] U.S. Cl. ..... 232/4 R; 446/9

[58] Field of Search ..... 232/1 D, 4 R, 43.1; 446/8, 9, 13; 229/8.5

[56] References Cited

U.S. PATENT DOCUMENTS

| | | | |
|---|---|---|---|
| 1,091,333 | 3/1914 | Heidel | 229/8.5 X |
| 1,100,356 | 6/1914 | Dade et al. | 446/13 X |
| 1,211,299 | 1/1917 | Doerwald | 232/4 R |
| 2,218,431 | 10/1940 | McGee | 446/8 |
| 4,121,826 | 10/1978 | Liberatore | 232/4 R X |

*Primary Examiner*—Robert P. Swiatek

[57] ABSTRACT

A safe coin box is provided and consists of a conduit that has an elongated coin passage so constructed that the conduit cannot be removed from the coin box after it is inserted within a slot therein and removal of coins from the coin box is prevented through the conduit when a blade is inserted therein.

1 Claim, 4 Drawing Figures

SAFE COIN BOX

BACKGROUND OF THE INVENTION

The instant invention relates generally to coin banks and more specifically it relates to a safe coin box.

Numerous coin banks have been provided in prior art that are adapted to retain coins received within the banks. For example, U.S. Pat. Nos. 993,979; 2,218,431 and 3,143,285 all are illustrative of such prior art. While these units may be suitable for the particular purpose to which they address, they would not be as suitable for the purposes of the present invention as heretofore described.

SUMMARY OF THE INVENTION

A primary object of the present invention is to provide a safe coin box that will overcome the shortcomings of the prior art devices.

Another object is to provide a safe coin box that is so constructed in which once a coin conduit is inserted within a slot within the top of the coin box the conduit cannot be removed therefrom.

An additional object is to provide a safe coin box that is constructed to prevent removal of coins from the coin box with a blade through the coin conduit.

A further object is to provide a safe coin box that is simple and easy to use.

A still further object is to provide a safe coin box that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
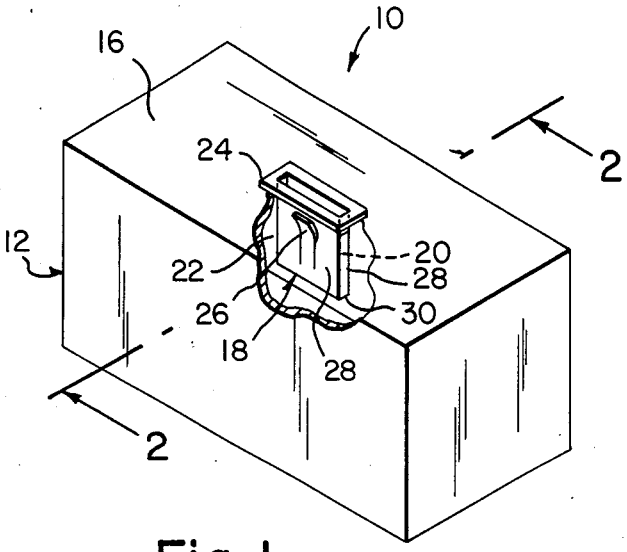
FIG. 1 is a perspective view of the invention with parts broken away.
Figure 2:
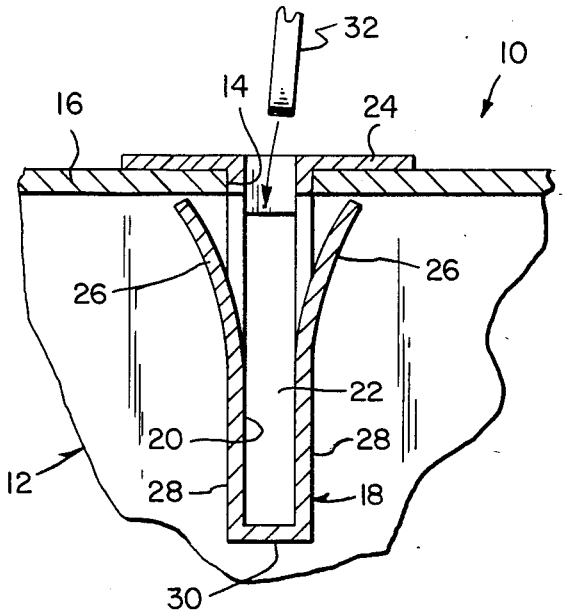
FIG. 2 is an enlarged cross sectional view taken along line 2—2 in FIG. 1 showing the conduit in greater detail.

Turning now descriptively to the drawings, in which similar reference characters denote similar elements throughout the several views, FIGS. 1 and 2 illustrate a safe coin box 10 that consists of a housing 12 that has a slot 14 within top wall 16 thereof and a conduit 18 that has an elongated coin passage 20 with an open end 22. A flange 24 is formed on top end of the conduit 18 for engaging the top wall 16 of the housing 12 after the conduit 18 is inserted within the slot 14.

A pair of fingers 26 are each formed integrally with and flared outwardly from opposite sides 28 of the conduit 18. After the conduit 18 is inserted within the slot 14, tops of the fingers 26 will engage the interior surface of the top wall 16, preventing the conduit 18 from being removed from the housing 12.

An abutment member 30 is disposed between the opposite sides 28 of the conduit 18, in line with and remotely located from the top of the coin passage 20 for allowing a coin 32 to enter the housing 12 laterally through the open end 22. The abutment member 30 will prevent insertion of a blade (not shown) into the housing 12 through the conduit 18 for removing coins 32 therefrom. The coins 32 once deposited within the coin box 10 cannot be removed without destroying the housing 12.

Figure 3:
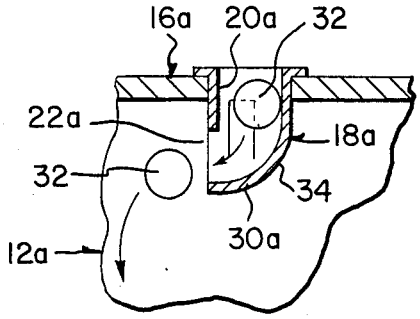
FIG. 3 is a cross sectional view of a modification showing a curved conduit therein to prevent theft of coins therefrom.

FIG. 3 shows a modification in which the conduit **18*a* is curved at lower portion 34 of the elongated coin passage 20*a* and integral with the abutment member 30*a* for guiding the coin 32 laterally through the open end 22*a***.

Figure 4:
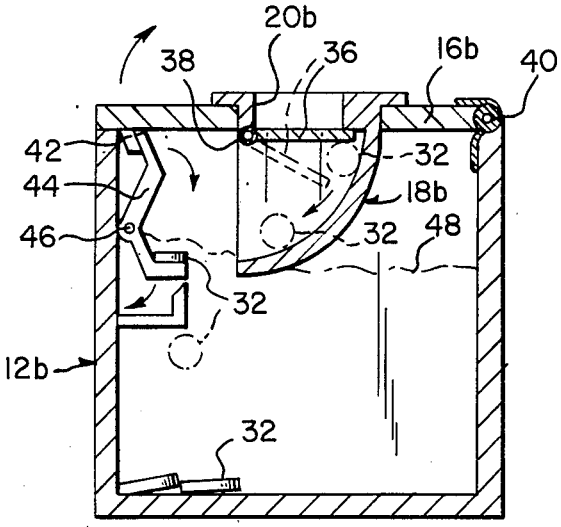
FIG. 4 is a cross sectional view of another modification showing a spring biased, normally opened top held closed by a coin weighted latch released mechanism, the top includes a spring biased, normally closed trap door over a curved conduit therein to prevent theft of coins therefrom.

FIG. 4 shows another modification in which a conduit **18*b* further contains a spring biased normally closed trap door 36 hinged at 38 to the upper portion of the elongated coin passage 20*b* and that will open inwardly when the coin 32 is inserted therein, which will aid in preventing insertion of a blade into the housing 12*b* for removing the coins 32** therefrom.

The top wall **16*b* is hinged at one end 40 to the housing 12*b* and is spring biased normally open thereto. A latch 42 is connected to other end of the top wall 16*b* and extends inwardly into the housing 12*b*. A coin weighted, latch release mechanism 44 is pivotally mounted at 46 in the housing 12*b*. When the housing is filled to a predetermined height 48 the coins 32 will activate the latch release mechanism 44 allowing the top wall 16*b*** to open for removal of the coins therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safe coin box having a top wall and slot through said wall in combination with a conduit with a top end and coin passageway mounted in said slot, wherein said passageway has a curved lower portion, said conduit further comprises a hinged spring biased normally closed trap door above said lower portion of said elongated coin passage that will open inwardly when a coin is inserted therein, which will aid in preventing insertion of a blade into said housing for removing said coins therefrom, further comprising:

(a) said top wall hinged at one end to said housing and being spring biased normally open thereto;

(b) a latch connected to the other end of said top wall and extending inwardly into said housing; and (c) a coin weighted latch release mechanism pivotally mounted in said housing such that when said housing is filled to a predetermined height said coins will activate said latch release mechanism allowing said top wall to open for removal of said coins therefrom.

* * * * *